US012286781B2

(12) United States Patent
Lee et al.

(10) Patent No.: US 12,286,781 B2
(45) Date of Patent: Apr. 29, 2025

(54) TOILET BOWL BIDET CAPABLE OF PREVENTING DROPLETS FROM SPLASHING WHEN TOILET IS FLUSHED

(71) Applicant: QUOSS CO., LTD., Incheon (KR)

(72) Inventors: Sang Yun Lee, Seoul (KR); Pil Won Bong, Ansan-si (KR); Heung Soon Lee, Hwaseong-si (KR)

(73) Assignee: QUOSS CO., LTD., Incheon (KR)

( * ) Notice: Subject to any disclaimer, the term of this patent is extended or adjusted under 35 U.S.C. 154(b) by 194 days.

(21) Appl. No.: 18/347,913

(22) Filed: Jul. 6, 2023

(65) Prior Publication Data

US 2023/0349140 A1 Nov. 2, 2023

Related U.S. Application Data

(63) Continuation of application No. PCT/KR2022/007709, filed on May 31, 2022.

(30) Foreign Application Priority Data

Feb. 7, 2022 (KR) ..... 10-2022-0015193

(51) Int. Cl.
*E03D 9/08* (2006.01)
*E03D 5/10* (2006.01)

(52) U.S. Cl.
CPC ..... *E03D 9/08* (2013.01); *E03D 5/105* (2013.01)

(58) Field of Classification Search
CPC ..... E03D 9/08
See application file for complete search history.

(56) References Cited

U.S. PATENT DOCUMENTS 4,709,426 A * 12/1987 Godwin, Jr. ..... E03D 9/00 4/300.3
8,161,580 B2 * 4/2012 Hashidume ..... E03D 9/08 4/444
11,339,560 B2 * 5/2022 Nelson ..... E03D 11/13
11,806,732 B2 * 11/2023 Nelson ..... E03D 11/13

FOREIGN PATENT DOCUMENTS

JP 2019132051 A 8/2019
KR 2020000018283 U 10/2000
KR 100999399 B1 12/2010
KR 1020110038101 A 4/2011
KR 1020140013724 A 2/2014

* cited by examiner

*Primary Examiner* — Janie M Loeppke
(74) *Attorney, Agent, or Firm* — NKL Law; Jae Youn Kim

(57) ABSTRACT

Disclosed is a toilet bowl bidet capable of preventing droplets from splashing, the toilet bowl bidet including a washing water supply hose (150) having an air pump (180) disposed at an outlet side of a washing water valve (160) and configured to mix air into washing water supplied to a bidet nozzle unit (140), wherein the bidet nozzle unit (140) includes first and second washing water passages (141) and (143) respectively including bidet nozzles (142) and (144), a third washing water passage (145) including a shield nozzle (146), and a distributor 148 configured to guide the washing water to a selected one of the first, second, and third washing water passages (141), (143), and (145). A controller (170) is configured to, when a flushing operation is performed, control the distributor (148) to supply air-mixed washing water to the third washing water passage (145) and open the washing water valve (160).

4 Claims, 5 Drawing Sheets

TOILET BOWL BIDET CAPABLE OF PREVENTING DROPLETS FROM SPLASHING WHEN TOILET IS FLUSHED

TECHNICAL FIELD

The present invention relates to a bidet installed in a toilet bowl, and more particularly to "a toilet bowl bidet capable of preventing droplets from splashing when a toilet is flushed", configured to prevent the droplets generated in a toilet bowl from splashing out of the toilet bowl when the toilet is flushed after the toilet is used and to keep the bathroom in a cleaner state.

BACKGROUND ART

In general, a bidet refers to a toilet seat configured to clean private parts of the human body. The bidet is installed not only in accommodation facilities such as a hotel and an inn but also in a toilet bowl, which is a toilet facility in the home. Further, the bidet is a sanitary facility capable of cleaning the user's anus or private parts therearound with washing water at an appropriate water pressure after the toilet is used without using toilet paper.

The bidet includes a toilet seat disposed along the upper portion of a toilet bowl, the toilet seat having an open center, a cleaning nozzle unit disposed at the rear side of an opening of the toilet seat and configured to spray washing water, and a controller disposed on one side of the toilet seat and provided with a plurality of operation buttons configured to control stop/power, toilet seat temperature, and operation of the cleaning nozzle unit. The toilet seat has a seat sensor installed therein and configured to sense whether a user is seated on the toilet seat. The controller determines whether the user is seated on the toilet seat through the seat sensor, and washing water is sprayed only when the user operates the cleaning nozzle unit through the operation buttons while being seated on the toilet seat. Furthermore, when the user flushes the toilet after using the toilet having the bidet installed therein, water stored in a water tank flows into the toilet bowl and the water is discharged while generating a vortex.

However, in such a conventional toilet bowl, when a toilet is flushed after a user uses the toilet, droplets (filth) splash on the bathroom floor due to vortex and countercurrent water pressure generated by flushing of the toilet. Particularly, there is a disadvantage in that the entire bathroom is contaminated by scattering of bacteria which are hardly visible to the naked eye. Meanwhile, the conventional toilet bowl tends to increase water drainage pressure by reducing direct water or a drainage pipe in order to save water. In this case, there is a disadvantage in that a vortex generated in the toilet bowl becomes stronger, and as such the amount of droplets and bacteria scattering increase further.

DISCLOSURE

Technical Problem

Therefore, the present invention has been made in view of the above problems, and it is an object of the present invention to provide "a toilet bowl bidet capable of preventing droplets from splashing when a toilet is flushed" configured to prevent the droplets generated by vortex and countercurrent water pressure when the toilet is flushed from splashing out of a toilet bowl by improving a bidet nozzle unit configured to spray washing water, thereby making it possible to keep the bathroom in a cleaner state.

Technical Solution

In accordance with the present invention, the above and other objects can be accomplished by the provision of a toilet bowl bidet including a toilet seat disposed on an upper portion of a toilet bowl, wherein the toilet seat has an open central portion so as to allow a user to be seated on the toilet seat and use a toilet, a seating sensor disposed on one side of the toilet seat and configured to detect whether the user is seated, a bidet nozzle unit disposed to be movable forwards and rearwards from a rear lower side of the toilet seat and configured to spray washing water from a tip thereof, a washing water valve disposed in the middle of a washing water supply hose and configured to control supply of the washing water to the bidet nozzle unit, and a controller disposed on one side of the toilet seat and provided with operation buttons configured to control opening and closing of the washing water valve.

The washing water supply hose has an air pump disposed at an outlet side of the washing water valve and configured to mix air into the washing water supplied to the bidet nozzle unit. The bidet nozzle unit incudes first and second washing water passages having bidet nozzles respectively disposed at upper portions of tips thereof and configured to spray the washing water toward user's anus and user's private parts, a third washing water passage having a shield nozzle disposed at a lower portion of a tip thereof and configured to spray the washing water in a dome shape toward a bottom portion of the toilet bowl, and a distributor configured to select any one of the first, second, and third washing water passages and to guide the washing water introduced by opening the washing water valve to the selected one of the first, second, and third washing water passages. The controller is configured to, when the seating sensor detects that the user rises from the toilet seat after using the toilet and a flushing operation of the toilet bowl is performed, control the distributor so as to supply air-mixed washing water to the third washing water passage and open the washing water valve for a predetermined time, and the air-mixed washing water is sprayed in the dome shape from the upper portion of the toilet bowl through the shield nozzle of the third washing water passage, thereby preventing droplets generated when the toilet bowl is flushed from splashing out of the toilet bowl.

The shield nozzle may have an inverted funnel-shaped diffusion guide disposed therein, and the air-mixed washing water may be discharged through the shield nozzle and sprayed in the dome shape along an outer surface of the diffusion guide.

The washing water supply hose may have a washing water heater disposed at an outlet side of the washing water valve and configured to heat the washing water supplied to the bidet nozzle unit to 35 to 45° C.

The controller may spray the washing water through the shield nozzle of the third washing water passage in a state in which the bidet nozzle unit is moved forwards.

Advantageous Effects

In "a toilet bowl bidet capable of preventing droplets from splashing when a toilet is flushed" according to the present invention, a flushing operation of a toilet bowl is performed when a seating sensor detects that a user rises from a toilet seat after using the toilet. Thereafter, a distributor guides air-mixed washing water so as to supply the same to a third washing water passage, and a washing water valve is opened for a predetermined time. Accordingly, the air-mixed washing water is sprayed in a dome shape from the upper portion of the toilet bowl through a shield nozzle of the third washing water passage, thereby having an effect of preventing the droplets generated by vortex and countercurrent water pressure when the toilet is flushed from splashing out of the toilet bowl and keeping the bathroom in a cleaner state.

Further, in "the toilet bowl bidet capable of preventing the droplets from splashing when the toilet is flushed" according to the present invention, the shield nozzle has an inverted funnel-shaped diffusion guide disposed therein, and the air-mixed washing water is discharged through the shield nozzle and more widely sprayed in a dome shape along the outer surface of the diffusion guide. Therefore, when the toilet is flushed, washing water is widely sprayed and discharged to cover the entire inside of the toilet bowl, thereby making it possible to more effectively prevent droplets generated at the inner bottom of the toilet bowl from splashing out of the toilet bowl.

Additionally, in "the toilet bowl bidet capable of preventing the droplets from splashing when the toilet is flushed" according to the present invention, a washing water supply hose has a washing water heater disposed at an outlet side of the washing water valve and configured to heat the washing water supplied to a bidet nozzle unit to 35 to 45° C., thereby further improving washing power and deodorizing effects through spraying of hot water.

Furthermore, in "the toilet bowl bidet capable of preventing the droplets from splashing when the toilet is flushed" according to the present invention, when washing water is sprayed through the shield nozzle of the third washing water passage in a state in which the bidet nozzle unit is moved forwards, a stream of water is maintained in a dome shape from the upper central portion of the toilet bowl toward the bottom portion thereof, thereby more effectively preventing droplets from splashing out of the toilet bowl.

DESCRIPTION OF DRAWINGS

The above and other objects, features and other advantages of the present invention will be more clearly understood from the following detailed description taken in conjunction with the accompanying drawings, in which.

REFERENCE NUMERALS

Figure 1:
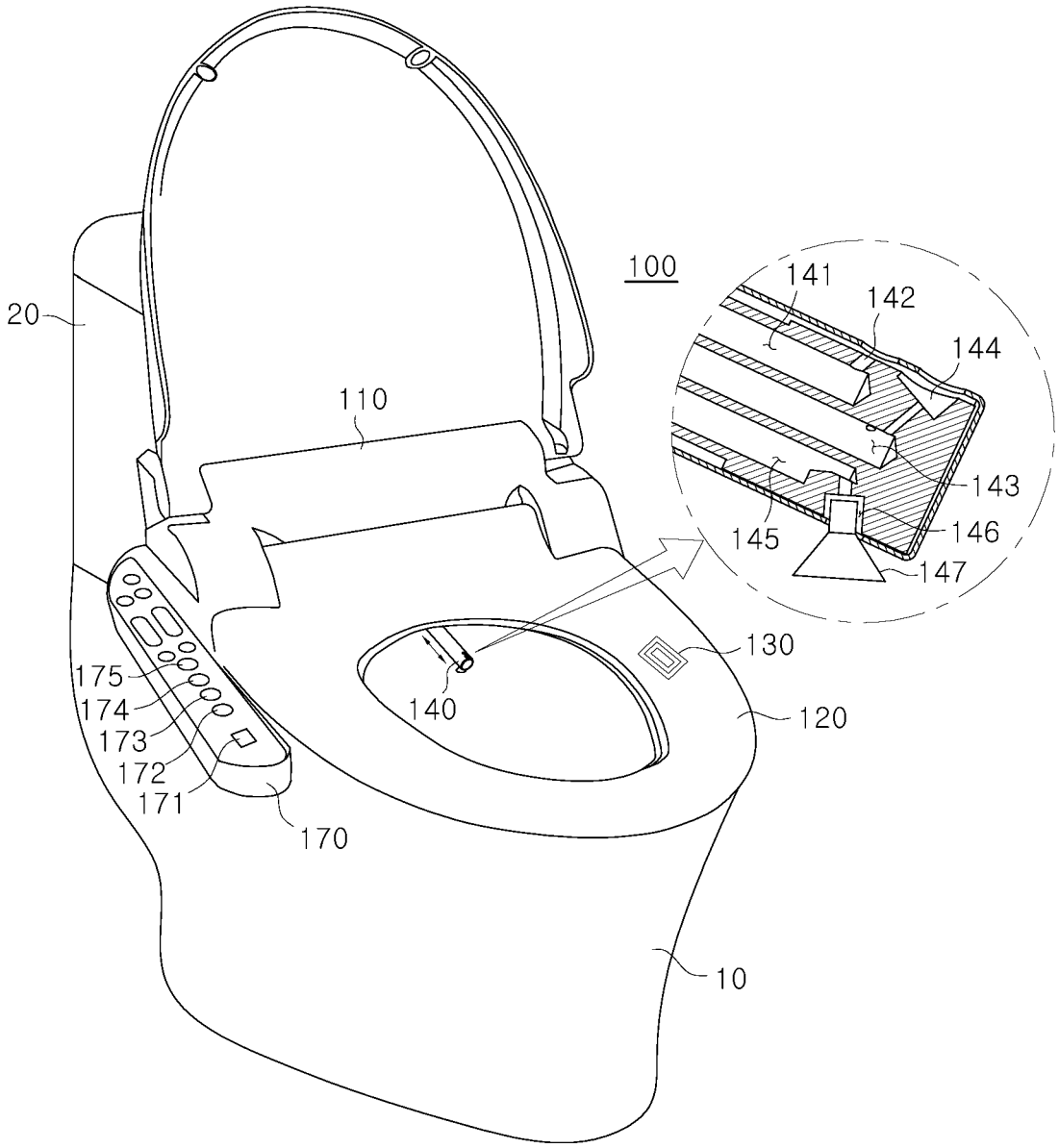
FIG. 1 is a diagram schematically showing a toilet bowl bidet according to the present invention.

10: Toilet bowl 20: Water tank 100: Bidet
110: Main body 120: Toilet seat 130: Seating sensor
140: Bidet nozzle unit 141: First washing water passage 142: Bidet nozzle
143: Second washing water passage 144: Bidet nozzle 145: Third washing water passage
146: Shield nozzle 147: Diffusion guide 148: Distributor
149: Rack bar 150: Washing water supply hose 160: Washing water valve
170: Controller 171 to 175: Operation button 180: Air pump
190: Washing water heater

BEST MODE

Figure 4:
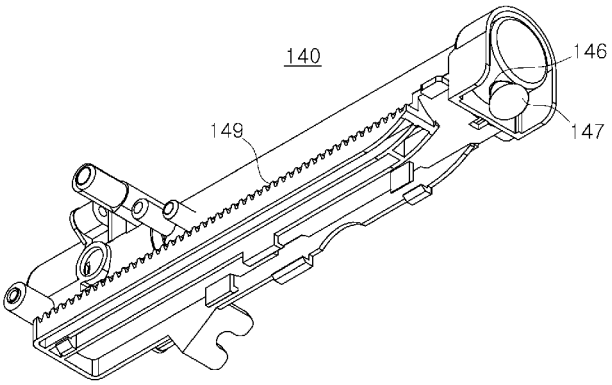
FIG. 4 is a diagram schematically showing a bottom structure of the bidet nozzle unit according to the present invention.
Figure 5:
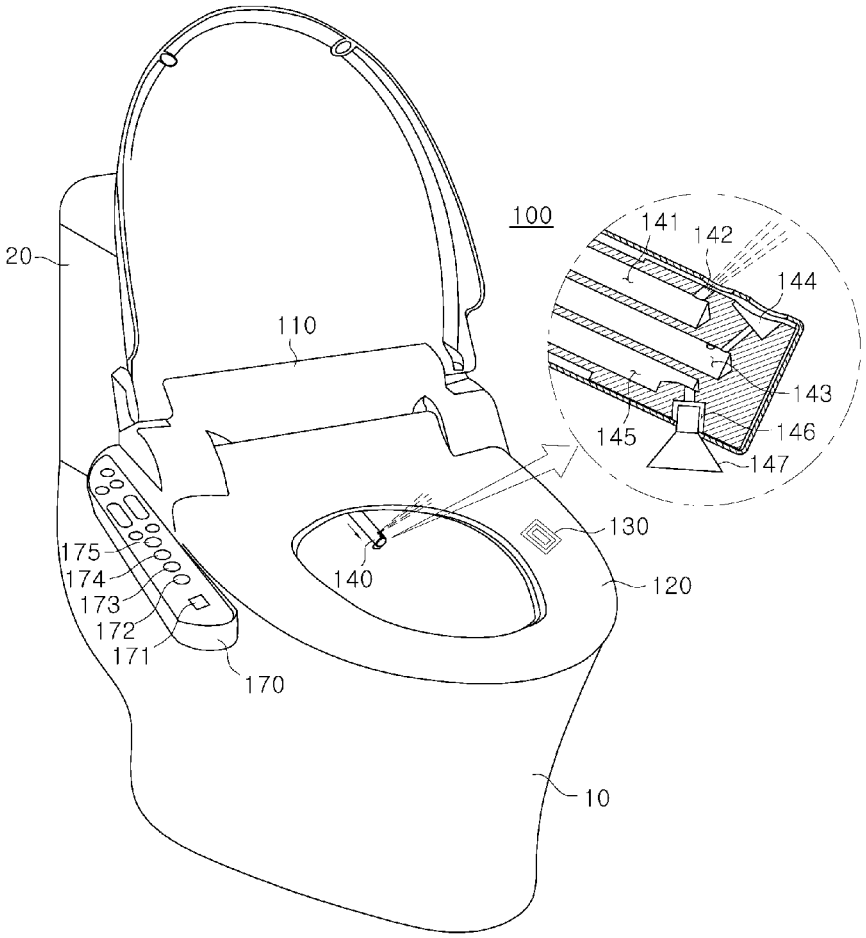
FIG. 5 is a diagram showing a washing water spraying operation in a washing mode of the bidet according to the present invention.
Figure 6:
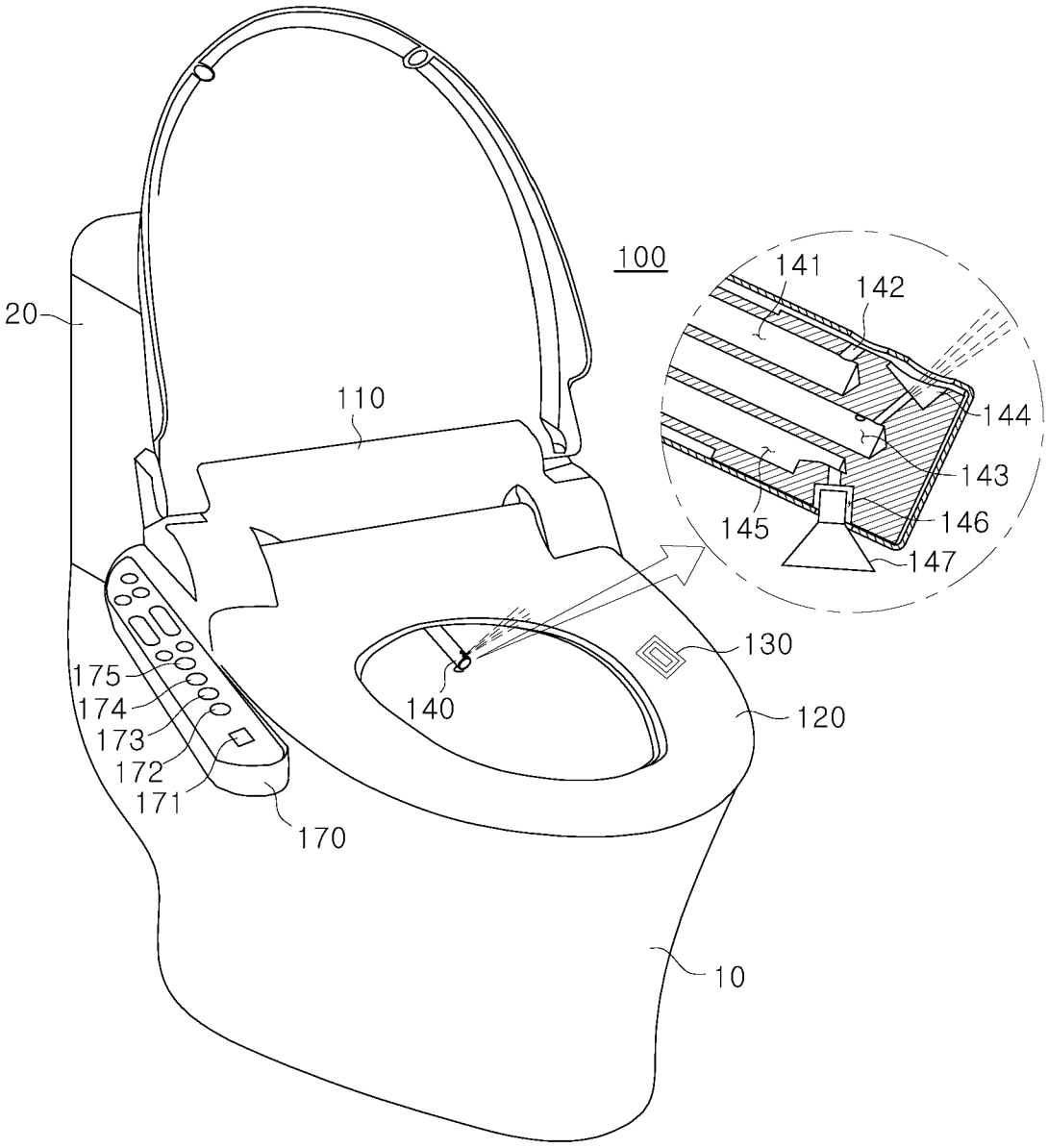
FIG. 6 is a diagram showing a washing water spraying operation in a bidet mode of the bidet according to the present invention.
Figure 7:
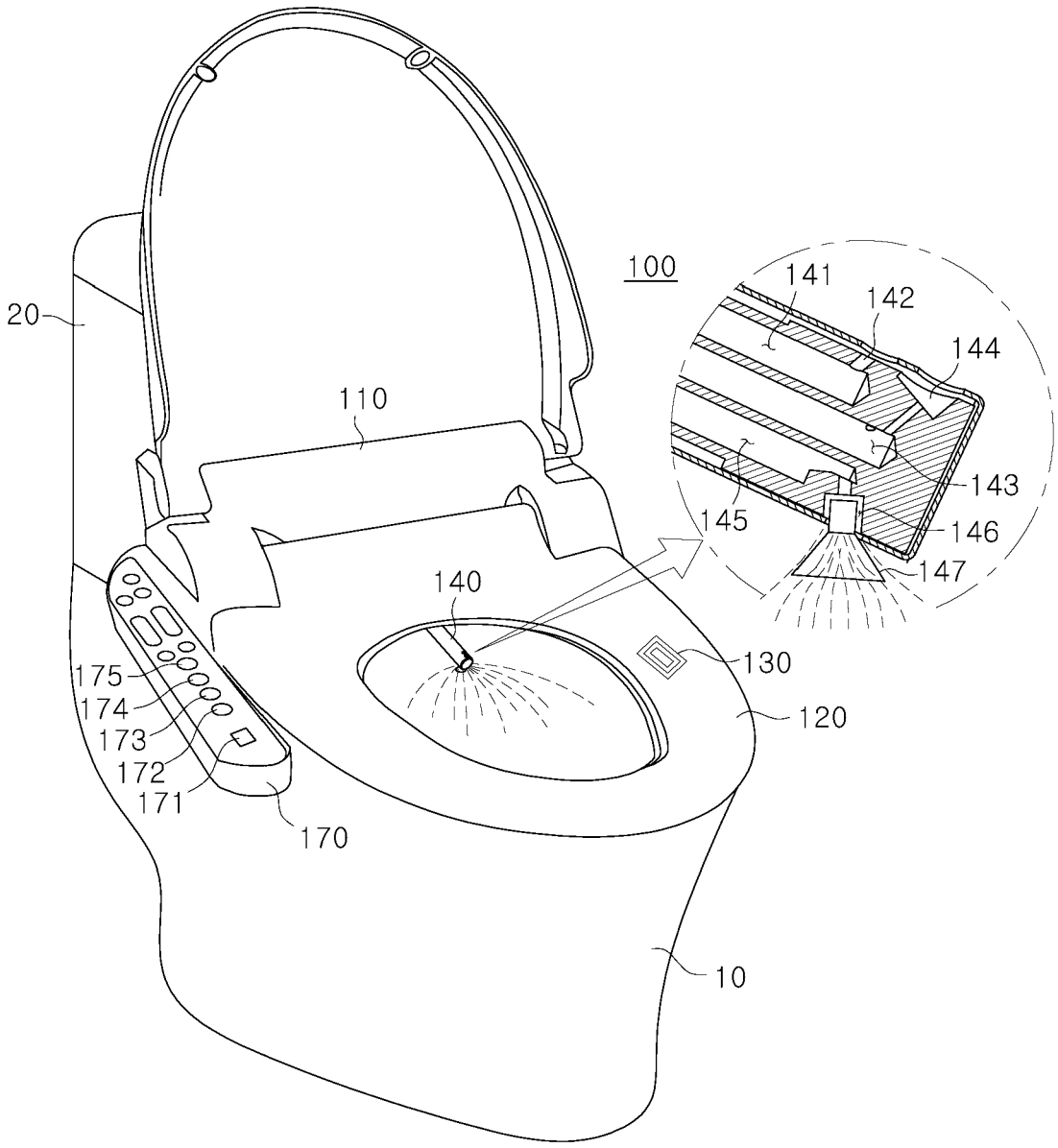
FIG. 7 is a diagram showing a washing water spraying operation in a flushing mode of the bidet according to the present invention.

Hereinafter, one preferred embodiment according to the present invention will be described with reference to the accompanying drawings. Briefly referring to the drawings, FIGS. 1 to 4 are drawings showing an overall configuration of a toilet bowl bidet and a configuration of a bidet nozzle unit according to the present invention, and FIGS. 5 to 7 are diagrams showing a washing water spraying operation in each mode of the toilet bowl bidet according to the present invention.

Figure 2:
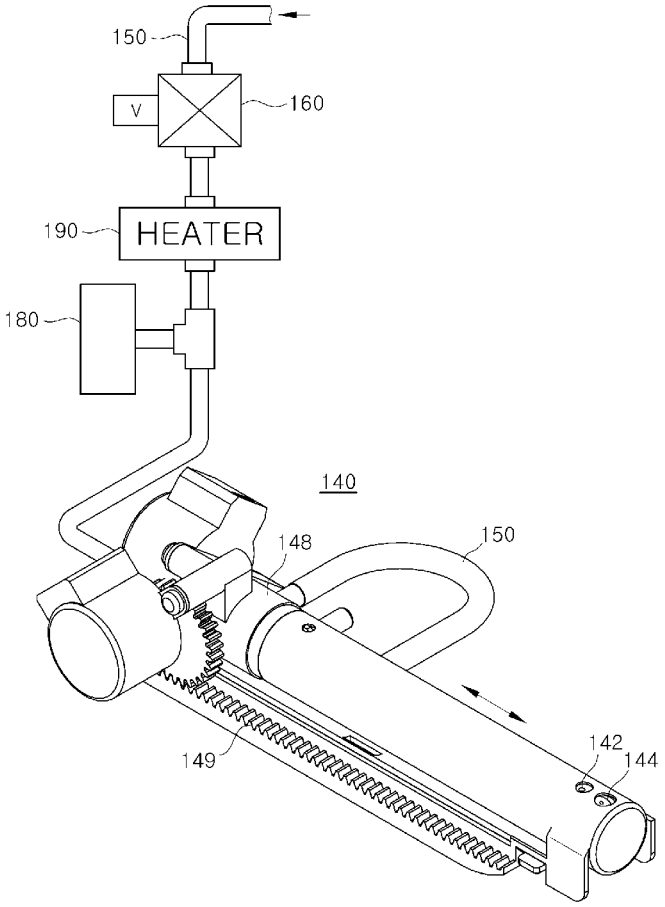
FIGS. 2 and 3 are diagrams schematically showing a bidet nozzle unit of the toilet bowl bidet according to the present invention.
Figure 3:
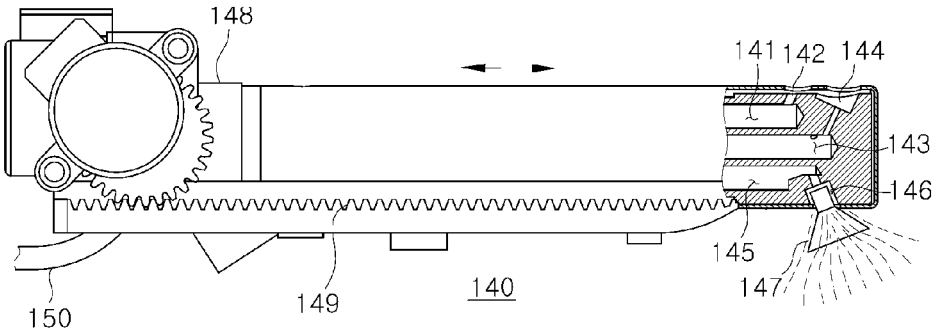

As shown in FIGS. 1 to 3, a "toilet bowl bidet 100 capable of preventing droplets from splashing when a toilet is flushed" according to the present invention includes a main body 110 having an electrical component disposed therein and fixed to a rear portion of a toilet bowl 10, a toilet seat 120 hinged to a front portion of the main body 110 and placed on the toilet bowl 10, a seating sensor 130 configured to detect whether a user is seated, a bidet nozzle unit 140 disposed to be movable forwards and rearwards from a rear lower side of the toilet seat 120 and configured to spray washing water from a tip thereof, a washing water valve 160 disposed in the middle of a washing water supply hose 150 and configured to control supply of the washing water to the bidet nozzle unit 140, and a controller 170 disposed on one side of the toilet seat 120 and provided with an operation button configured to control opening and closing of the washing water valve 160.

The toilet seat 120 is disposed on an upper portion of the toilet bowl 10, and the same has an open central portion so that a user uses the toilet while being seated thereon.

The seating sensor 130 is disposed on one side of the toilet seat 120 and configured to detect whether the user is seated, and the same is preferably made of an electrostatic sensor capable of detecting contact of the user's buttocks through which microcurrent passes. The controller 170 is programmed to determine, using the seating sensor 130, whether the user is seated on the toilet seat 120 while using the toilet or rises from the toilet seat 120 after using the toilet.

The tip of the bidet nozzle unit 140 is disposed at a central portion of the main body 110 so as to be inclined downwards toward the center of the toilet bowl 10. Particularly, the bidet nozzle unit 140 is disposed to be movable forwards and rearwards from a rear lower side of the toilet seat 120, and the same may spray washing water from the tip thereof. To this end, as shown in FIGS. 2 and 3, the bidet nozzle unit 140 includes first and second washing water passages 141 and 143 configured to be movable forwards and rearwards along a rack bar 149 fixedly disposed at the central portion of the main body 110. Here, the first and second washing water passages 141 and 143 include bidet nozzles 142 and 144 respectively disposed at upper portions of the tips thereof and configured to spray washing water toward the user's anus and the user's private parts. Further, the bidet nozzle unit 140 includes a third washing water passage 145 including a shield nozzle 146 disposed at a lower portion of the tip thereof and configured to spray washing water in a dome shape toward a bottom portion of the toilet bowl 10, and a distributor 148 configured to select any one of the first, second, and third washing water passages 141, 143, and 145 and to guide washing water introduced from the outside to the selected one of the first, second, and third washing water passages 141, 143, and 145. The bidet nozzle 142 of the first washing water passage 141 is provided to wash the anus of a male user and a female user, and the bidet nozzle 144 of the second washing water passage 143 is provided to wash private parts of a female user. In addition, the shield nozzle 146 of the third washing water passage 145 is provided to form a shield membrane by spraying washing water in a dome shape from the upper portion of the toilet bowl 10 when the toilet bowl 10 is flushed. As shown in FIGS. 3 and 4, the shield nozzle 146 has an inverted funnel-shaped diffusion guide 147 disposed therein. Here, the diameter of the diffusion guide 147 increases from an upper portion of the diffusion guide 147 toward a lower portion thereof. Here, while washing water is discharged through the shield nozzle 146, the same is sprayed in a dome shape along the outer surface of the diffusion guide 147. More specifically, the bidet nozzles 142 and 144 are configured to spray washing water upwards toward the user's anus or user's private parts, whereas the shield nozzle 146 is configured to widely spray washing water in a dome shape from the top inside the toilet bowl 10 in a downward direction.

The distributor 148 selects one of the first, second, and third washing water passage 141, 143, and 145 and guides washing water introduced from the outside to the selected one of the first, second, and third washing water passages 141, 143, and 145 by driving a motor in each control mode. Driving of the distributor 148 is programmed in the controller 170 according to each mode.

As shown in FIG. 2, the washing water valve 160 is disposed in the middle of the washing water supply hose 150 and configured to control the supply of washing water to the bidet nozzle unit 140, and the same is preferably formed of a solenoid valve openable and closable by an electrical signal from the controller 170. In addition, the washing water supply hose 150 has an air pump 180 disposed at the outlet side (downstream side) of the washing water valve 160 and configured to mix air into washing water supplied to the bidet nozzle unit 140. Air is mixed into the washing water in order to more gently spray water for washing (cleaning). In addition, the washing water supply hose 150 includes a washing water heater 190 disposed at the outlet side of the washing water valve 160 and configured to heat the washing water supplied to the bidet nozzle unit 140 to 35 to 45° C. In the embodiment of the present invention, washing water is set to be heated to about 40° C. while passing through the washing water heater 190. This serves to further improve washing power and deodorizing power by supplying hot water to the bidet nozzle unit 140 side.

The controller 170 is disposed on one side of the toilet seat 120 so that a user conveniently operates the same while being seated on the toilet seat 120. Here, the controller 170 has a plurality of buttons 171 to 175 disposed therein and configured to control various functions such as stop/power (button 171), washing (button 172), bidet (button 173), drying (button 174), and deodorization (button 175). That is, when the user presses the washing button 172 after using the toilet, the distributor 148 guides air-mixed washing water to the first washing water passage 141, and then the washing water is sprayed through the bidet nozzle 142 of the first washing water passage 141. Further, when the bidet button 173 is pressed, the distributor 148 guides air-mixed washing water to the second washing water passage 143, and then the air-mixed washing water is sprayed through the bidet nozzle 144 of the second washing water passage 143.

Meanwhile, when the user rises from the toilet seat 120, the controller 170 opens a flushing valve (not shown) of a water tank 20 having water stored therein by mechanical or electrical operation, thereby performing a water flushing operation. In addition, the controller 170 controls the distributor 148, the washing water valve 160, and the air pump 180 so as to spray the air-mixed washing water through the shield nozzle 146 of the third washing water passage 145 for a predetermined time.

Next, a spraying process of washing water of the bidet nozzle unit 140 according to the operation mode of the controller 170 and effects thereof will be described more in detail with reference to FIGS. 5 to 7.

First, after a user is seated on the toilet seat 120 and uses a toilet, the user presses the washing button 172 of the controller 170 in this state. Thereafter, the bidet nozzle unit 140 moves forwards by a predetermined distance, washing water introduced from the outside is guided to the first washing water passage 141 by the distributor 148, and the washing water valve 160 is opened for a predetermined time and the air pump 180 is driven. Therefore, as shown in FIG. 5, air-mixed washing water is sprayed upwards through the bidet nozzle 142 of the first washing water passage 141, thereby washing the user's anus and its surroundings. Meanwhile, the washing water introduced by opening of the washing water valve 160 is heated while passing through the washing water heater 190, so that washing is performed using hot water at about 40° C. This washing mode operation is performed for a certain time set in the controller 170, and when spraying of washing water is completed during the set time, the bidet nozzle unit 140 moves rearwards and maintains a standby state.

Further, after a female user is seated on the toilet seat 120 and urinates, the female user presses the bidet button 173 of the controller 170. Thereafter, the bidet nozzle unit 140 moves forwards by a predetermined distance, washing water introduced from the outside is guided to the second washing water passage 143 by the distributor 148, and the washing water valve 160 is opened for a predetermined time and the air pump 180 is driven. Therefore, as shown in FIG. 6, air-mixed washing water is sprayed upwards through the bidet nozzle 144 of the second washing water passage 143, thereby washing private parts of the female user and the surroundings. The washing water introduced at the time of opening the washing water valve 160 passes through the washing water heater 190 and is heated, thereby performing washing with hot water at about 40° C. This bidet mode operation is performed for a certain time set in the controller 170, and when spraying of washing water is completed during the set time, the bidet nozzle unit 140 moves rearwards again to maintain a standby state.

Meanwhile, when a user rises from the toilet seat 120 after using the toilet, the controller 170 opens a flushing valve (not shown) of the water tank 20 having water stored therein by mechanical or electrical operation, thereby performing a water flushing operation. In addition, the controller 170 opens the washing water valve 160 and operates the same for a predetermined time (13 to 16 seconds in the embodiment of the present invention) and drives the air pump 180. Further, the controller 170 controls the distributor 148 so as to guide washing water introduced from the outside to the third washing water passage 145. Therefore, as shown in FIG. 7, in a toilet flushing mode, air-mixed washing water is sprayed in a dome shape from the top of the toilet bowl 10 downwards through the shield nozzle 146 of the third washing water passage 145 for a predetermined time. Accordingly, when the toilet bowl 10 is flushed, it is possible to prevent droplets generated by vortex and countercurrent water pressure from splashing out of the toilet bowl 10. Particularly, since the inverted funnel-shaped diffusion guide 147 is disposed in the shield nozzle 146, the air-mixed washing water is discharged through the shield nozzle 146 and is more widely sprayed in a dome shape along the outer surface of the diffusion guide 147. In this case as well, washing water flowing through the washing water valve 160 is heated while passing through the washing water heater 190, and hot water at about 40° C. is sprayed and discharged through the shield nozzle 146 and the diffusion guide 147. The operation of spraying washing water through the shield nozzle 146 of the third washing water passage 145 may be performed in a state in which the bidet nozzle unit 140 is moved rearwards or forwards. Preferably, as shown in FIG. 7, when washing water (hot water) is sprayed through the shield nozzle 146 of the third washing water passage 145 in the state in which the bidet nozzle unit 140 is moved forwards, a stream of water is maintained in a dome shape downwards from the upper center of the toilet bowl 10, thereby making it possible to more effectively prevent droplets from splashing.

INDUSTRIAL APPLICABILITY

As is apparent from the above description, the present invention is widely usable in the field of a "toilet bowl bidet" configured to prevent droplets generated in a toilet bowl from splashing out of the toilet bowl by improving a bidet nozzle unit and spraying washing water in a dome shape toward a bottom portion of the toilet bowl when a toilet is flushed.

The invention claimed is:

1. A toilet bowl bidet capable of preventing droplets from splashing when a toilet is flushed, the toilet bowl bidet comprising:

a toilet seat (120) disposed on an upper portion of a toilet bowl (10), wherein the toilet seat (120) has an open central portion so as to allow a user to be seated on the toilet seat (120) and use the toilet;

a seating sensor (130) disposed on one side of the toilet seat (120) and configured to detect whether the user is seated;

a bidet nozzle unit (140) disposed to be movable forwards and rearwards from a rear lower side of the toilet seat (120) and configured to spray washing water from a tip thereof;

a washing water valve (160) disposed in the middle of a washing water supply hose (150) and configured to control supply of the washing water to the bidet nozzle unit (140); and a controller (170) disposed on one side of the toilet seat (120) and provided with operation buttons (171 to 175) configured to control opening and closing of the washing water valve (160), wherein:

the washing water supply hose (150) has an air pump (180) disposed at an outlet side of the washing water valve (160) and configured to mix air into the washing water supplied to the bidet nozzle unit (140);

the bidet nozzle unit (140) comprises first and second washing water passages (141) and (143) having bidet nozzles (142) and (144) respectively disposed at upper portions of tips thereof and configured to spray the washing water toward user's anus and user's private parts, a third washing water passage (145) having a shield nozzle (146) disposed at a lower portion of a tip thereof and configured to spray the washing water in a dome shape toward a bottom portion of the toilet bowl (10), and a distributor (148) configured to select any one of the first, second, and third washing water passages (141), (143), and (145) and to guide the washing water introduced by opening the washing water valve (160) to the selected one of the first, second, and third washing water passages (141), (143), and (145);

the controller (170) is configured to, when the seating sensor (130) detects that the user rises from the toilet seat (120) after using the toilet and a flushing operation of the toilet bowl (10) is performed, control the distributor (148) so as to supply air-mixed washing water to the third washing water passage (145) and open the washing water valve (160) for a predetermined time; and the air-mixed washing water is sprayed in the dome shape from the upper portion of the toilet bowl (10) through the shield nozzle (146) of the third washing water passage (145), thereby preventing the droplets generated when the toilet bowl (10) is flushed from splashing out of the toilet bowl (10).

2. The toilet bowl bidet according to claim 1, wherein:

the shield nozzle (146) has an inverted funnel-shaped diffusion guide (147) disposed therein; and the air-mixed washing water is discharged through the shield nozzle (146) and sprayed in the dome shape along an outer surface of the diffusion guide (147).

3. The toilet bowl bidet according to claim 1, wherein the washing water supply hose (150) has a washing water heater (190) disposed at an outlet side of the washing water valve (160) and configured to heat the washing water supplied to the bidet nozzle unit (140) to 35 to 45° C.

4. The toilet bowl bidet according to claim 1, wherein the controller (170) sprays the washing water through the shield nozzle (146) of the third washing water passage (145) in a state in which the bidet nozzle unit (140) is moved forwards.

* * * * *